US006216300B1

(12) United States Patent
Hannagan

(10) Patent No.: US 6,216,300 B1
(45) **Date of Patent: *Apr. 17, 2001**

(54) PATIENT SUPPORTS AND METHODS OF OPERATING THEM

(75) Inventor: Angus Patrick Douglas Hannagan, Waterlooville (GB)

(73) Assignee: Pegasus Limited, Waterlooville (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/437,214

(22) Filed: Nov. 10, 1999

Related U.S. Application Data

(63) Continuation of application No. 08/855,717, filed on May 8, 1997, now Pat. No. 5,983,428.

(30) Foreign Application Priority Data

Dec. 18, 1996 (GB) ..... 9626014

(51) Int. Cl.[7] ..... A61G 7/057

(52) U.S. Cl. ..... 5/713; 5/715; 5/933

(58) Field of Search ..... 5/706, 710, 713, 5/714, 715, 910, 914, 933

(56) References Cited

U.S. PATENT DOCUMENTS

| | | | | |
|---|---|---|---|---|
| 5,138,729 | * | 8/1992 | Ferrand | 5/713 |
| 5,586,346 | * | 12/1996 | Stacy et al. | 5/715 X |
| 5,685,036 | * | 11/1997 | Kopfstein et al. | 5/713 |
| 5,745,942 | * | 5/1998 | Wilkerson | 5/715 |
| 5,815,864 | * | 10/1998 | Sloop | 5/706 |
| 5,983,428 | * | 11/1999 | Hannagan | 5/713 |

FOREIGN PATENT DOCUMENTS

| | | | | |
|---|---|---|---|---|
| WO 86/02244 | * | 4/1986 | (WO) | 5/910 |

* cited by examiner

*Primary Examiner*—Michael F. Trettel
(74) *Attorney, Agent, or Firm*—Larson & Taylor PLC

(57) ABSTRACT

In operation of a support for a patient's body, used in medical or veterinary treatment, which applies alternating-pressure to the body in order to reduce or minimize the risk of pressure sores caused by prolonged pressure on the skin, inflatable cells of the support are inflated and deflated cyclically in a predetermined sequence. To provide improved effect in relieving or preventing pressure sores, the cells are deflated in the sequence in such a manner that the interior pressure falls from 10 mmHg (135 Pa) to 0 mmHg in a time period of not more than 15 s. Preferably the interior pressure falls to below 0 mmHg (ambient atmospheric pressure). A vacuum pump or pumps may be employed to achieve this result.

30 Claims, 5 Drawing Sheets

PATIENT SUPPORTS AND METHODS OF OPERATING THEM

This is a continuation of application Ser. No. 08/855,717 filed May 8, 1997 and now U.S. Pat. No. 5,983,428.

FIELD OF THE INVENTION

The invention relates to supports for a patient's body, used in medical or veterinary treatment, and particularly to supports which apply alternating-pressure to the body in order to reduce or minimize the risk of pressure sores caused by prolonged pressure on the skin. Such supports may be for the whole body, in the form of beds or mattresses, or for a part of the body, for example chair seats such as wheelchair seats and calf supports. The invention also relates to methods of operating such body supports, and is particularly but not exclusively concerned with body supports having a plurality of inflatable cells which are inflated and deflated cyclically in groups, to apply the alternating-pressure to the body.

DESCRIPTION OF THE PRIOR ART

Many such body supports have been proposed and used in recent years. The assignors of the present inventor (Pegasus Airwave Ltd) make and sell two mattresses having arrays of inflatable tubes under the trade marks "Airwave" and "Bi-wave". The "Airwave" mattress is based on that disclosed in UK Patent 1 595 417 (now assigned to Pegasus Airwave Ltd). They have also disclosed an active wheelchair seat having an array of tubes (WO 94/07396) and an active calf support (WO 96/19175).

In arriving at the present invention, the inventor has paid attention, it is believed for the first time, to the stage of removal of pressure from the patient in such alternating-pressure devices. To gain understanding of the invention it is therefore necessary to collect together and review the clinical data and other reports in the background of pressure sore control.

Clinical data and research reports on this subject are rather sparse, despite the facts that pressure sores can have tragic consequences for patients, including widespread pain, infection, interrupted sleep patterns and impaired rehabilitation. In the most vulnerable patients serious pressure sores can be a cause of death. Recent studies commissioned by the UK Department of Health put the cost of pressures sore treatment at over £250 million per year.[1] (A list of references appears below). Pressure sores affect about 10% of hospital patients. A large number of specialised support surfaces are now available to complement skilled nursing practice but there is little evidence by which the efficacy of these products can be analysed. Of a range of 48 products surveyed in 1992 [2], 50% had no evidence of effectiveness, a further 21% had only anecdotal information to support claims, and a further 21% only had laboratory interface pressure study evaluation. Only four mattress systems had been studied in a clinical trial and only two of these trials had been adequately designed with randomisation of patients. A clinical trial carried out by Exton Smith et al [3] looked at the effectiveness of the Airwave system of preventing pressure sores (mentioned above) compared with a conventional large cell ripple mattress. Superficial or deep sores developed in 42% of the patients nursed on the conventional mattress whilst only 6.5% of the Airwave-nursed patients broke down.

A survey was published in 1992 [4] of the users of the Pegasus Airwave system. This survey conducted in 1991 represents the largest database in the current pattern of use of any pressure-relieving mattress, surveying 788 patients in 119 sites. In this survey only 4.9% of patients developed new sores, thus supporting the data gathered in the original trial carried out by Exton Smith et al [3]. Nevertheless it was apparent that the product was not always successful at preventing pressure sores.

The original premise on which alternating-pressure systems were designed was that arterial occlusion occurred at 32 mmHg interface pressure (1 mmHg equals 13.5 Pa). This is based on work carried out by Eugene Landis in 1929 [5], which was not directed at a pressure sore study and in which all the results were obtained from healthy individuals. 32 mmHg was the average pressure of the arteriolar limb of the subjects but venous pressure ranged from 6 to 18 mmHg with an average of 12 mmHg. These figures obtained from healthy subjects are much better than the figures to be expected from a high risk patient. Equipment which merely lowers the interface pressure below this level of arterial closure will not allow blood to flow and hence relieve ischaemic tissue in all patients. This assumes that by reducing interface pressure below the level of internal closure pressure, blood will flow. Le et al in 1984 [6] showed that pressures are higher within tissue than they are at the skin and that pressure sores would originate within tissue near bony prominences, also that internal pressures may be 3–5 times greater than surface or interface pressures.

Sangeorzan et al [7] were able to conclude that tissue pressure should not exceed 8 mmHg when measuring subcutaneous pressures that caused total arrest of oxygen in human tissue. When these facts are looked at in light of Le et al [6] then interface pressures of 1.6–2.6 mmHg are necessary to relieve the ischaemic tissue. Kosiak summed this up in 1961 [8] stating that "Since it is impossible to completely eliminate all pressure for a long period of time, it becomes imperative that the pressure be completely eliminated at frequent intervals in order to allow circulation to the ischaemic tissues".

The current Airwave system reliably achieves this complete elimination but still nearly 5% of patients using the system broke down. Products of other manufacturers claiming phases of zero pressures have appeared but these also have patients still breaking down. Having noted this apparent contradiction, the present inventors sought to achieve improved reduction of pressure sores.

In the light of the present invention as disclosed below it should be mentioned that in GB-A-1595417 it is disclosed that the tubes of the mattress are deflated by connection to a vacuum source, in the form of a compressor which is said to provide pressure and vacuum for the pressure cycling of the arrays of tubes. The exact arrangement is not disclosed, and it is indicated that the inlet to the compressor from the tubes is also an inlet from the atmosphere. The Airwave mattress as manufactured does not use such an arrangement, but vents the tubes to atmosphere. To the present inventors' best knowledge, no inflatable body support system actually used has employed a source of below atmosphere pressure to deflate its cells during the normal cycling of the cells.

WO 92/07541 on the other hand discloses a mattress of the low air loss type, in which air escapes continuously from the cells via holes or pores in order to dry and cool the patient's skin, so that deflation in normal cycling occurs by this slow air loss rather than by opening of a conduit to atmosphere. To provide for rapid deflation in an emergency requiring cardio-pulmonary resuscitation (CPR) in which the patient must be on a firm surface, there is a CPR mode in which the air cells are connected to the input side of the blower for venting to atmosphere. The aim is rapid total deflation, rather than any control of pressure as in the cycling mode.

SUMMARY OF THE INVENTION

The object of the invention is to provide methods and arrangements for the improved relief and prevention of pressure sores, in systems employing alternating-pressure.

The invention is based on the realization that rapid reduction of the interface pressure applied by the support to the patient, during the pressure removal phase in the cycling of the support, and particularly rapid reduction in the region of low interface pressure, provides improvement in control and avoidance of pressure sores.

In a first aspect the invention provides a method of operating an inflatable body support having a plurality of inflatable cells, comprising inflating and deflating the cells cyclically in a predetermined sequence, wherein the cells are deflated in the predetermined cyclical sequence in such a manner that the interior pressure falls from 10 mmHg (135 Pa) to 0 mmHg in a time period of not more than 15 s, preferably not more than 10 s.

In this application cell internal pressures are expressed relative to ambient atmospheric pressure (0 mmHg).

Furthermore, the invention provides a method in which in the predetermined cyclical sequence the cells are deflated in such a manner that the interior pressure falls from 20 mmHg (270 Pa) to 0 mmHg in not more than 30 s, more preferably in not more than 20 s.

In order to obtain the desired pressure-reduction curve, preferably the cells are deflated in the cyclical sequence to a pressure which is less than ambient atmospheric pressure. In this case, the lowest interior pressure of the cells in said cyclical sequence is preferably in the range 0 mmHg to 10 mmHg (135 Pa) (more preferably 0 mmHg to 5 mmHg) below ambient atmospheric pressure, in order that the amount of air needed to re-inflate each cell is minimized.

Although any suitable method may be employed to provide the desired pressure-reduction curve, preferably the cells are deflated in the cyclical sequence by pumping gas from them by means of at least one vacuum pump.

The invention therefore defines in various ways the lower end of the pressure-reduction curve of the cell interior pressure during the normal alternating-pressure cycle. This concept applies to each cell, and depending on the exact nature of the device it is not necessary that a plurality of cells are deflated simultaneously. Preferably the pressure-reduction rates specified by this invention apply to all alternating-pressure cells of the support.

For convenience of construction and operation, it is preferable that the cells are arranged in a plurality of groups, each group containing at least one cell and usually a plurality of cells, the cells of each group being inflated and deflated together in the cycle out of phase with the cycle of the cells of the or each other group. In a mattress for example the cells may be transverse tubes, and there are typically two or three groups of cells with horizontally adjacent cells belonging to different groups. In a chair seat, there may be for example four tubes extending in the front-to-back direction and arranged in two groups.

The invention can further be defined by reference to the interface pressure applied to the patient's skin by a support device. In this respect the invention provides a method of operating an inflatable body support having a patient at least partly supported thereon, which support has a plurality of height-displaceable elements which support the patient and are arranged in groups each group comprising at least one said element, comprising causing the groups of elements to undergo cyclic raising and lowering in a predetermined sequence so that the groups sequentially support the patient, wherein during the lowering of the elements in the sequence the elements are operated in a manner such that interface pressure exerted between at least some of the elements and the patient falls from 20 mmHg (270 Pa) to 5 mmHg (68 Pa) in not more than 15 s, preferably in not more than 10 s. Preferably the interface pressure is reduced to 0 mmHg by the lowering of said elements.

In use of an alternating-pressure support, not all of the support elements may be supporting the patient, and some elements may provide only light support. The concept of the invention, of rapid interface pressure-reduction applies particularly to those support elements applying significant interface pressure, e.g. at least 40 mmHg when raised.

In this aspect the invention is not limited to use of inflatable cells, and other arrangements of height-displaceable elements which have been proposed in the past. Preferably however, the elements are upper portions of inflatable cells of flexible material.

In the past, it has been thought undesirable to interpose a cover sheet between the patient and the alternating-pressure device, because of the fear of "bridging" of the sheet between adjacent elements of the device which might prevent removal of interface pressure. However with the rapid pressure relief of the present invention, this risk is reduced, and therefore at least one sheet of flexible material may be present between the patient and the height-displaceable elements.

A device which applies sufficient suction to the inflatable cells of an alternating-pressure device can provide the desired rapid pressure-reduction. In another aspect therefore, the invention provides a method of operating an inflatable body support having a plurality of inflatable cells, comprising inflating and deflating the cells cyclically in a predetermined sequence, wherein the cells are deflated in the predetermined cyclical sequence in such a manner that the interior pressure of each cell falls to below 0 mmHg (ambient atmospheric pressure). As explained above, it is preferable that the lowest interior pressure of the cell in the cyclical sequence is in the range 0 mmHg to 10 mmHg (135 Pa) below ambient atmospheric pressure, more preferably in the range 0 mmHg to 5 mmHg below ambient atmospheric pressure.

The invention further provides apparatuses for carrying out the methods described above.

In one aspect, the invention provides an inflatable body support having a plurality of inflatable cells, inflation means for inflating the cells, suction means for deflating the cells, control means for causing the cells to be connected to the inflation means and the suction means cyclically in a predetermined cyclical sequence so that the cells are inflated and deflated, the suction means being adapted to establish a pressure lower than ambient atmospheric pressure in the cells, and the control means connecting the suction means to the cells for a sufficient time in the predetermined cyclical sequence that a pressure lower than ambient atmospheric pressure is established in the cells.

Preferably there is at least one sensor arranged to sense suction pressure applied to the cells by the suction means, the control means operating to stop application of suction to the cells when a predetermined minimum suction pressure is sensed by the sensor.

The invention also provides an inflatable body support having a plurality of inflatable cells, inflation means for inflating the cells, suction means for deflating the cells, control means for causing the cells to be connected to the inflation means and the suction means cyclically in a predetermined cyclical sequence so that the cells are inflated and deflated, the suction means being adapted to reduce pressure in said cells when connected thereto in the predetermined cyclical sequence at a rate such that the interior pressure in the cells falls from 10 mmHg (135 Pa) to 0 mmHg in not more than 15 s, preferably not more than 10 s.

In yet another aspect the invention provides an inflatable body support having a plurality of inflatable cells, inflation means for inflating the cells, suction means for deflating the cells, control means for causing the cells to be connected to the inflation means and the suction means cyclically in a predetermined cyclical sequence so that the cells are inflated and deflated, the suction means being adapted to reduce pressure in said cells when connected thereto in the predetermined cyclical sequence at a rate such that the interior pressure in the cells falls from 20 mmHg (270 Pa) to 0 mmHg in a time period of not more than 30 s, preferably not more than 20 s.

Preferably the inflation means comprises at least one air compressor and the suction means comprises at least one air pump, the air compressor and the air pump being independent of each other, e.g. independently controlled and unaffected by each other's operation.

BRIEF INTRODUCTION OF THE DRAWINGS

Further explanation of the invention and embodiments of it will now be described, by way of non-limitative example, with reference to the accompanying drawings. In the drawings.

DESCRIPTION OF THE PREFERRED EMBODIMENTS

In arriving at the present invention, the inventor noted some studies, which were carried out in connection with pressure sores and some of which were performed on healthy individuals, showing that following a period of circulatory occlusion there is a period of reactive hyperaemia which has the effect of increasing the rate of blood flow to the effected tissues as pressure is relieved. The maximum flow occurs immediately after the occlusion is released, the larger the occlusion the greater being the hyperaemia that follows. Lewis and Grant [(9)] showed a close relationship between the "debt" accrued during occlusion and the "repayment" during the hyperaemia phase. Blair et al [(10)] showed that if pressure was relieved slowly little or no "debt" was repaid.

The reason that the rate of fall of interface pressure reduces in prior art systems such as the Airwave is that the air is pushed out of the cells by patient weight and then the pressure-reduction merely continues by an equalisation process to atmospheric pressure dependent on the internal flow characteristics of the mattress. The time that patient weight ceases to be a factor is determined by the time when the adjacent inflated cells provide support for the patient on either side of the deflating cell.

The level of interface pressure which will occlude the micro-circulation in a healthy individual is likely to be at least 30 mmHg, but in a typical patient at risk of pressure sores this is often 10–15 mmHg whilst for patients with existing sores and at very high risk this is likely to be less than 5 mmHg. At these very low interface pressures the rate of reduction of pressure is low, and therefore the stimulation of the micro-circulation is greatly reduced if present at all.

Figure 1:
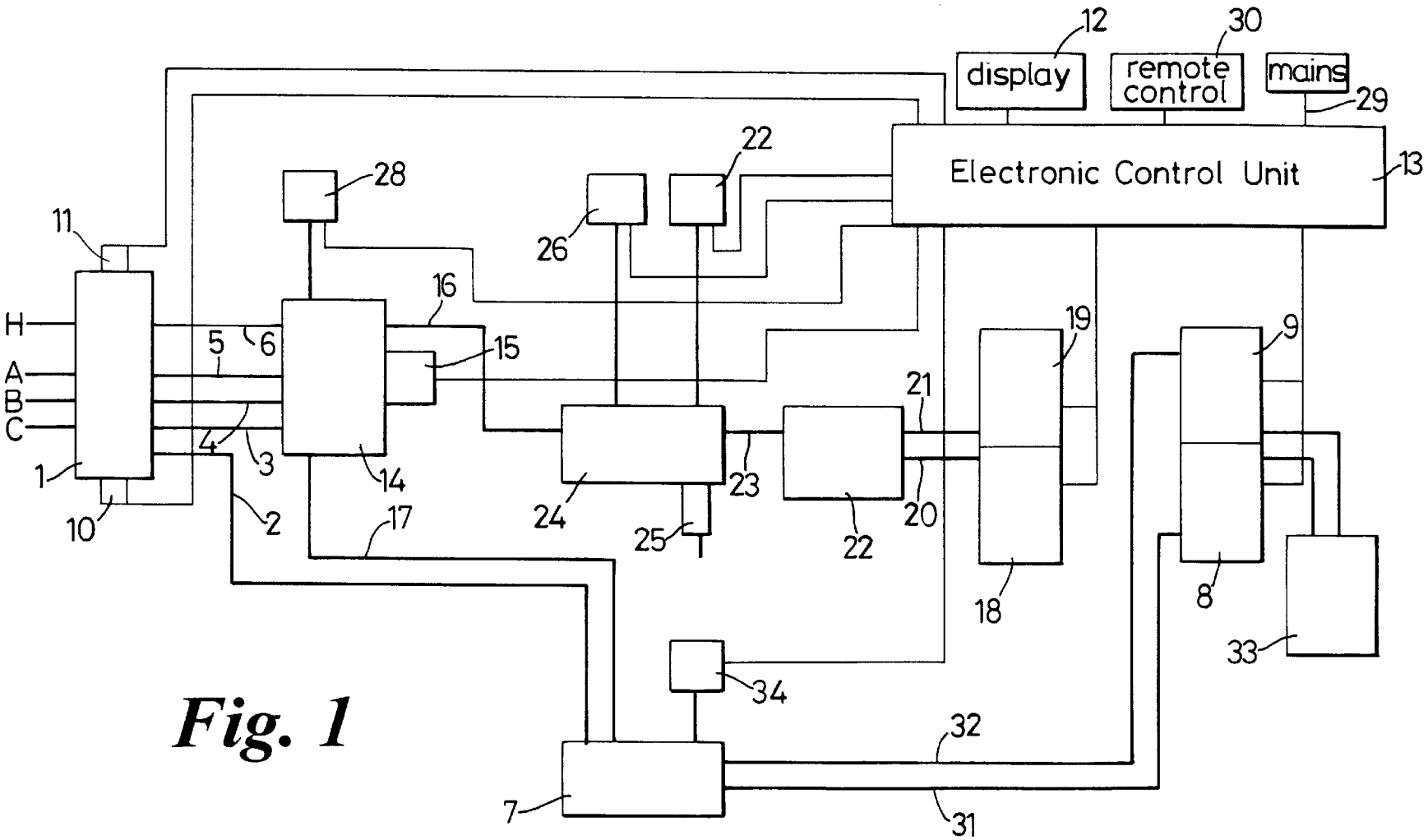
FIG. 1 is a block diagram of the control system of an inflatable pressure-alternating mattress of the invention.

The apparatus shown in FIG. 1 achieves rapid removal of interface pressure at the lower end of the pressure curve. This is achieved by connecting the deflating cell or cells to pressure which is below atmospheric pressure, by the use of one or more air pumps which actively provide such sub-atmospheric pressure. However within the invention other suitable means of providing suction, such as a vacuum reservoir, may be employed.

In the diagram of FIG. 1, air lines are shown by bold lines, and the light lines indicate control functions. The control system shown is connected by four air lines A, B, C, H seen at the left hand side, to an inflatable mattress of the standard Pegasus Airwave type, which is substantially as shown in GB-A-1 595 417, having a plurality of tubes extending transversely across the mattress and arranged in two layers, with each tube in the upper layer being supported directly above a tube of the lower layer by side formers. In the Airwave mattress, the side formers are also inflatable elements, and additionally there are inflatable head cells of the mattress. The side formers and head cells are kept permanently inflated, during normal operation of the device, by connection to the line H. The tubes are 10 cm (4 inches) in diameter.

The transverse alternating-pressure tubes in the mattress are divided into three groups or arrays, which are respectively connected to the lines A, B and C. Each of these arrays is cyclically inflated and deflated, in a cycle which includes a period in which the tubes of the array are maintained fully inflated and a period in which they are deflated. The total cycle duration is 8 minutes. The cycles of the three arrays are out of phase, so that at any time a patient lying on the mattress is supported by two of the arrays which are fully inflated or nearly so, while the third array is deflated so as to withdraw pressure from parts of the patient's body. Each tube of the upper layer is in the same array or group as the tube below it in the lower layer, so that these two tubes are inflated and deflated simultaneously.

The air lines A, B, C, H are connected by a connector device 1 to five air lines 2, 3, 4, 5, 6. This connector device 1 is shown and described fully in our co-pending UK Patent Application No. 9616769.7, to which reference should be made. It is disconnectable into two parts, to allow the mattress with the air lines A, B, C, H to be removed from the control system. Through relative rotation of two portions of one of these parts, the operator can select one of three functional positions of the connector 1. In a first position, the connector can be separated into its two parts, and in this position, the lines A, B, C, H are all closed at the connector, so that the mattress can be removed without deflation. In the other two positions, the connector cannot be separated into its two parts. In a first one of these positions, normal operation with cycling of the cells through their predetermined sequences takes place, the lines A, B, C, H being directly connected through the connector 1 to the various lines 3, 4, 5, 6. In the third position, known as the CPR position (cardio-pulmonary resuscitation position), all four of the lines A, B, C, H are connected both to a direct vent to atmosphere through the connector 1, this venting route having a one-way valve, and also to the suction line 2 which leads by a manifold 7 to two air pumps 8, 9 to be described later.

In this embodiment, the connector 1, unlike the connector shown in our UK Patent Application No. 9616769.7 has two optical sensors 10, 11, which detect which of the three positions it is in, and provide output signals so that the connector position can be displayed visually on the display 12 of the device, under control of the electronic control unit (ECU) 13.

The air lines 3, 4, 5, 6 are connected to ports of a rotary valve 14 which contains a stator and a rotor, the rotor being driven by a motor 15 which is controlled by the ECU 13. This rotary valve 14 also has ports connected to a fill line 16 and an exhaust line 17. The stator and rotor contain internal air passages connected to all of these ports, which are connected and disconnected to each other by the continuous rotation of the rotor in order to provide the desired control of the inflation and deflation of the cells of the mattress. The fill line 16 is connected at all times during normal operation of the mattress to the air line 6, so that the side formers and head cells connected to the line H are maintained permanently inflated during normal cycling operation. The fill line 16 is connected for predetermined periods in the cycling sequence to the lines 3, 4, 5 so that the respective arrays of cells connected to the lines A, B, C are inflated and maintained inflated for the desired periods. To cause deflation of each of the tube arrays in turn, the rotary valve 14 connects the lines 3, 4, 5 to the exhaust line 17.

The compressed air for the filling of the mattress is provided by two fill compressors 18, 19 which are also controlled by the ECU 13, and which in this embodiment are operated in tandem, i.e. both are on together or both off together. Their output lines 20, 21 are connected by a silencing and buffer chamber 22 and line 23 to a manifold 24 which has an output connected to the fill line 16. The manifold 24 also has an overpressure release safety valve 25 which opens to release air to the atmosphere at a predetermined overpressure, higher than the normal operating pressure of the tubes of the mattress. Also connected to the manifold are a low pressure sensor 26 and a high pressure sensor 27, which provide outputs to the ECU 13. Sensor 26 operates when the pressure drops below a predetermined value and the sensor 27 when the pressure reaches a higher predetermined value. The ECU 13 controls the operation of the compressors 18, 19 to maintain the pressure in the manifold 24 between these two values.

Connected to the rotary valve 24 is an overpressure sensor 28, which senses the pressure in the cell group or groups which are in the inflated phase. In this embodiment this operates at a predetermined pressure higher than that of the sensor 27, to provide an output signal when the pressure exceeds this level. On detection of this output signal, the ECU 13 gives a visual indication on display 12 that the mattress system is adjusting to the patient's weight. Overpressure may occur in the tubes of the mattress, when a patient is placed on the previously inflated mattress.

As FIG. 1 indicates, the ECU 13 has a mains power input 29, and is connected to the display 12 to indicate the operational state and provide other useful visual signals, and may optionally also be connectable to a remote control 30, for example by a cable or by infrared signalling. The ECU 13 contains a microprocessor, programmed to perform the desired control functions. The design and operation of the ECU 13 is conventional for one skilled in the art and need not be described here.

In the conventional Pegasus Airwave system, marketed hitherto, the arrays of tubes of the mattress have been vented to atmosphere by the rotary valve corresponding to the rotary valve 14 of FIG. 1, in order to deflate them in the normal cycling mode. As FIG. 1 shows, in this embodiment of the present invention, the exhaust line 17 is connected to the manifold 7, which itself is connected by two vacuum lines 31, 32 to the respective air pumps 8, 9 which when operating provide a sub-atmospheric pressure in the manifold 7. The outputs from the pumps 8, 9 pass through a silencing chamber 33 to atmosphere. These two pumps 8,9 also operate in tandem, under control of the ECU 13. In the manifold 7 there is a chamber connecting both lines 31, 32 to the two lines 2, 17.

Figure 2:
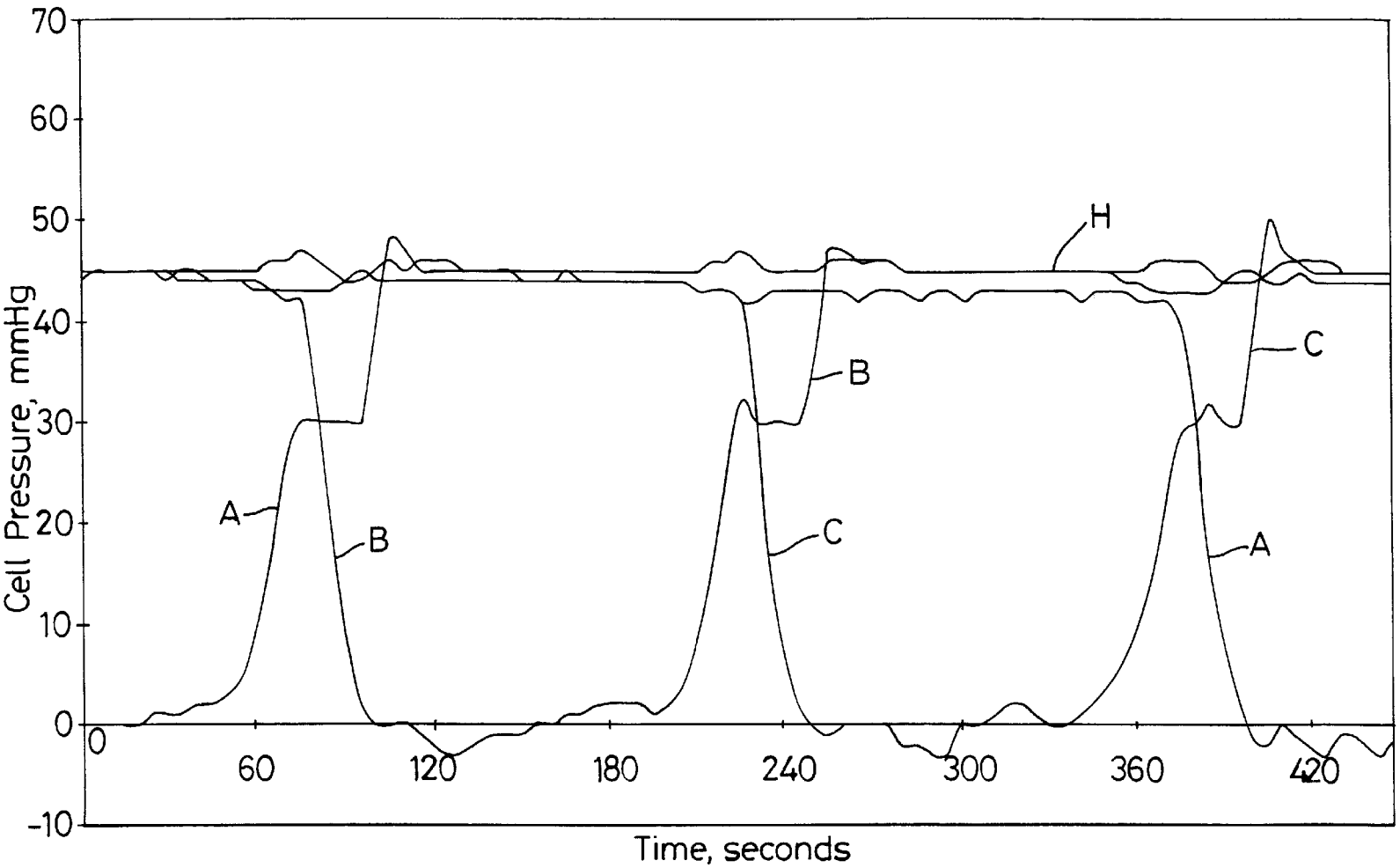
FIGS. 2 and 3 are graphs plotting the cell pressure against time, respectively for alternating-pressure mattresses of FIG. 1 and of the prior art.
Figure 4:
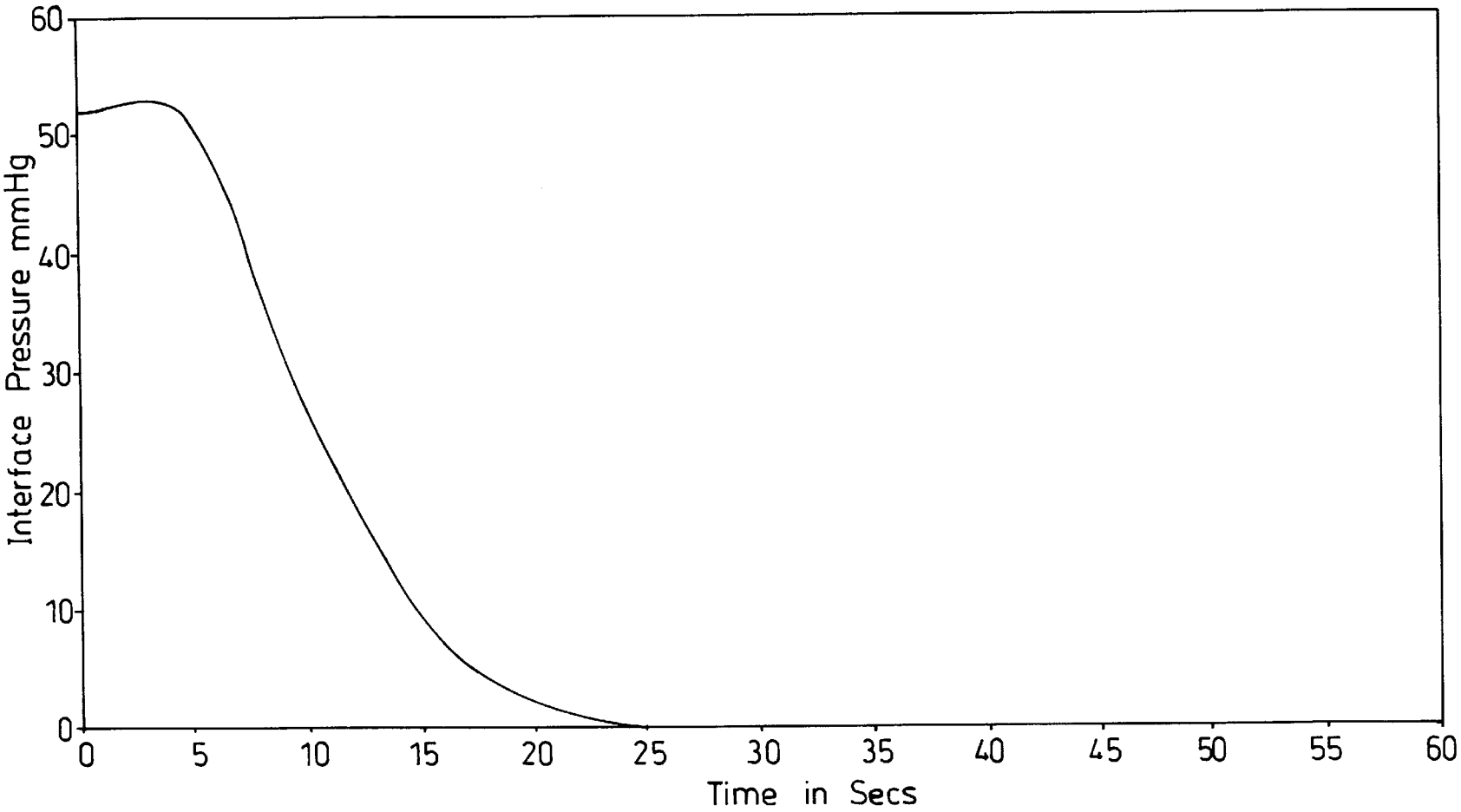
FIGS. 4 and 5 are graphs plotting the interface pressure against time, respectively for alternating-pressure mattresses of FIG. 1 and of the prior art.

During the normal cycling operation of the arrays of tubes of the mattress, with a patient on the mattress, the lines A, B, C are connected via the connector 1 and the rotary valve 14 in turn to the exhaust line 17, for the sequential deflation of the respective tube arrays. The passage of air from the deflating cells to the atmosphere occurs as a result of the initial overpressure in the cells relative to atmosphere and by the suction or vacuum extraction caused by the operation of the compressors 8, 9. The characteristic pressure-reduction curves are shown by FIGS. 2 and 4, and are discussed more below.

In order that the pumps 8, 9 do not extract excessive air from the deflated tubes, which air would need to be replaced on re-inflation of the tubes in the next stage of the cycle with extra energy consumption, the manifold 7 is connected to a vacuum sensor 34 which provides an output signal to the ECU 13 when it senses that a predetermined pressure below atmospheric pressure is reached in the manifold 7. The ECU 13 then switches off the pumps 8, 9. Of course, the pressure in the manifold 7 is not identical to the pressure in the tube array being deflated, but it has been found possible by trial and error to set a suitable switching level of the compressors 8, 9 so that extraction of air from the tubes stops at a level of pressure within the tubes of the mattress which is significantly below atmospheric pressure but not more than 5 mmHg below atmospheric pressure.

The fill compressors 18, 19 and the air pumps 8, 9 are small linear motor reciprocating compressors or pumps, and may all be identical. Preferably each pair is mounted on a support base so that their moving pistons reciprocate 180° out of phase, minimizing vibration. Suitable compressors are those shown in WO 94/28306, WO 94/28308 and WO 96/18037. These compressors have valves which seal the air passages when the compressors are not operating, so that there is no loss of air through the compressors 18, 19 when they are not operating, and no back leakage of air from atmosphere through the pumps 8, 9 when they are not operating. In the event of power failure, therefore, the mattress remains as it is, i.e. deflation is prevented.

The mattress has air conduits extending longitudinally along it, and connected to the tubes of the respective tube arrays. In the present embodiment, the air lines A, B, C are connected to these longitudinal air conduits at the middle region of the mattress, so that the tubes at the centre of the mattress tend to be inflated and deflated before the tubes at the respective ends of the mattress. In an alternative possible arrangement, the lines A, B, C are connected to these longitudinal conduits at one end of the mattress. A patient lying on the mattress may experience slightly different sensations with these two arrangements, as each array inflates and deflates.

In the CPR mode of the connector 1, all three arrays of tubes and the side formers and head cells are rapidly deflated, both by venting to atmosphere through the direct outlet path through the connector 1, for as long as there is sufficient pressure in the lines A, B, C, and also by the pumps 8, 9 via the line 2 and the manifold 7. When the CPR mode is detected by the optical sensors 10, 11, the ECU maintains the compressors 8, 9 in operation irrespective of the pressure in the manifold 7. This provides a more rapid complete deflation than is obtained by merely venting the tubes directly to atmosphere. Saving a few seconds of time is of great importance when the emergency CPR mode is required.

Figure 3:
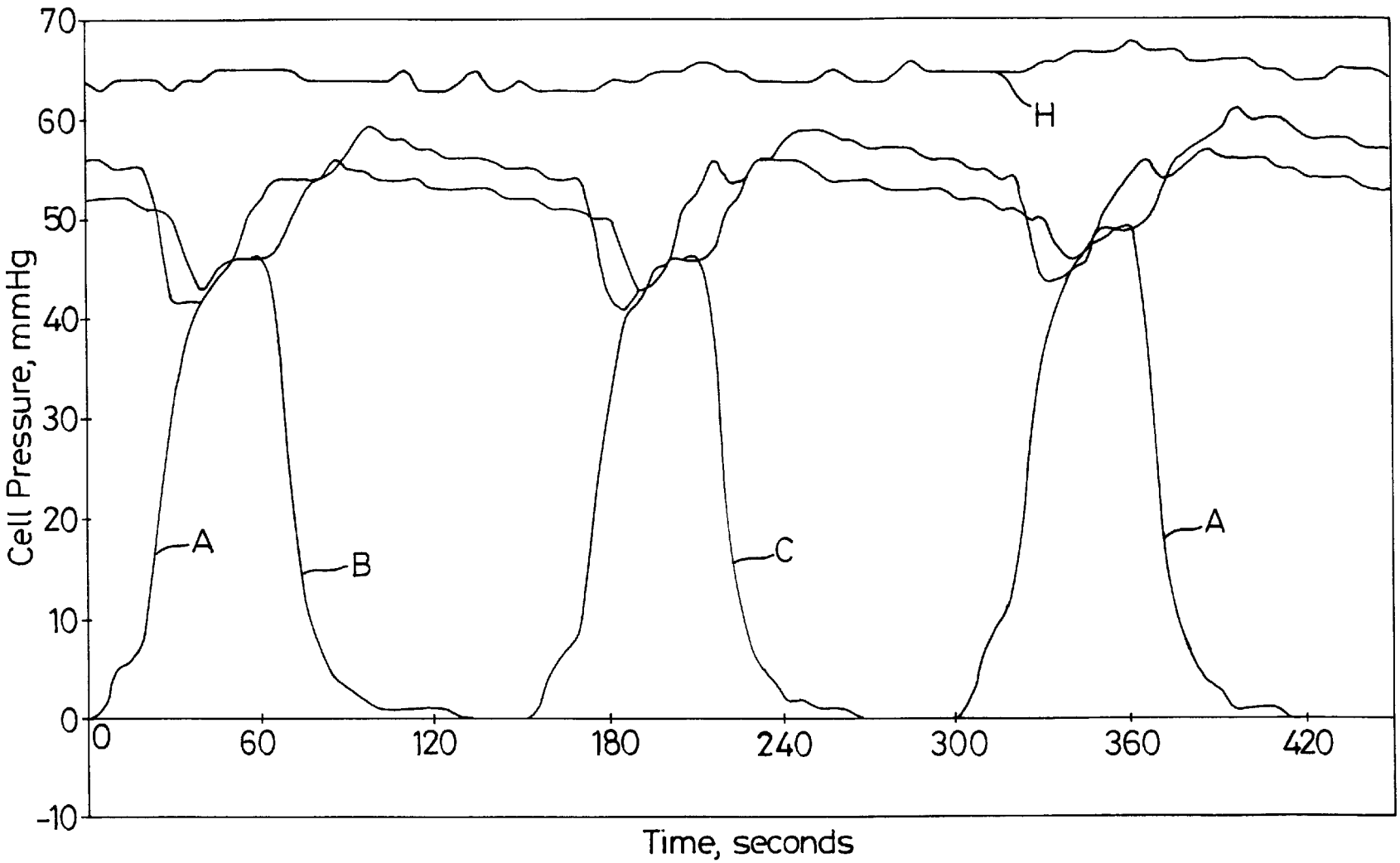

FIGS. 2 and 3 respectively show cell (tube) internal pressure curves obtained experimentally for the embodiment of the invention described above in which the standard Pegasus Airwave mattress is operated by the control system shown in FIG. 1, and for the standard Pegasus Airwave mattress in which the arrays of mattress tubes are vented to atmosphere only by the rotary valve during the normal cycling operation of the tubes of the mattress. The pressures within the mattress tubes were measured by attaching a conventional pressure-sensing device to the respective tubes. A standardised dummy patient weighing 83 kg was lying on the mattress.

FIG. 3 shows the cycling of the three tube arrays, identified-here as A, B and C, respectively connected to the air lines A, B and C, and also the continuously maintained high pressure of the head cells and side formers attached to the line H. Each tube array is-maintained inflated for a time period which is about twice as long as its deflation phase. When each deflation phase starts, the pressure drops rapidly, due to the weight of the patient, but the pressure drop rate decreases significantly below 10 mmHg, and 0 mmHg is only slowly approached. The sensitivity of measurement does not allow detection of whether or not a true pressure of 0 mmHg was actually achieved, but it is clearly impossible in such a system for a pressure lower than 0 mmHg to be obtained.

The pressure curves of FIG. 2 show that, on initiation of deflation of each cell array, there is initially a rapid pressure fall, similar to that of FIG. 3, but that this relatively rapid fall continues with only a slight rate reduction until 0 mmHg is obtained, and that a sub-atmospheric pressure is maintained within the tubes for a significant period of time. More precise measurements have shown that in the curves of FIG. 2, the internal pressure of the cells drops from 20 mmHg to 0 mmHg in about 15 seconds, and drops from 10 mmHg to 0 mmHg in much less than 10 seconds.

Figure 5:
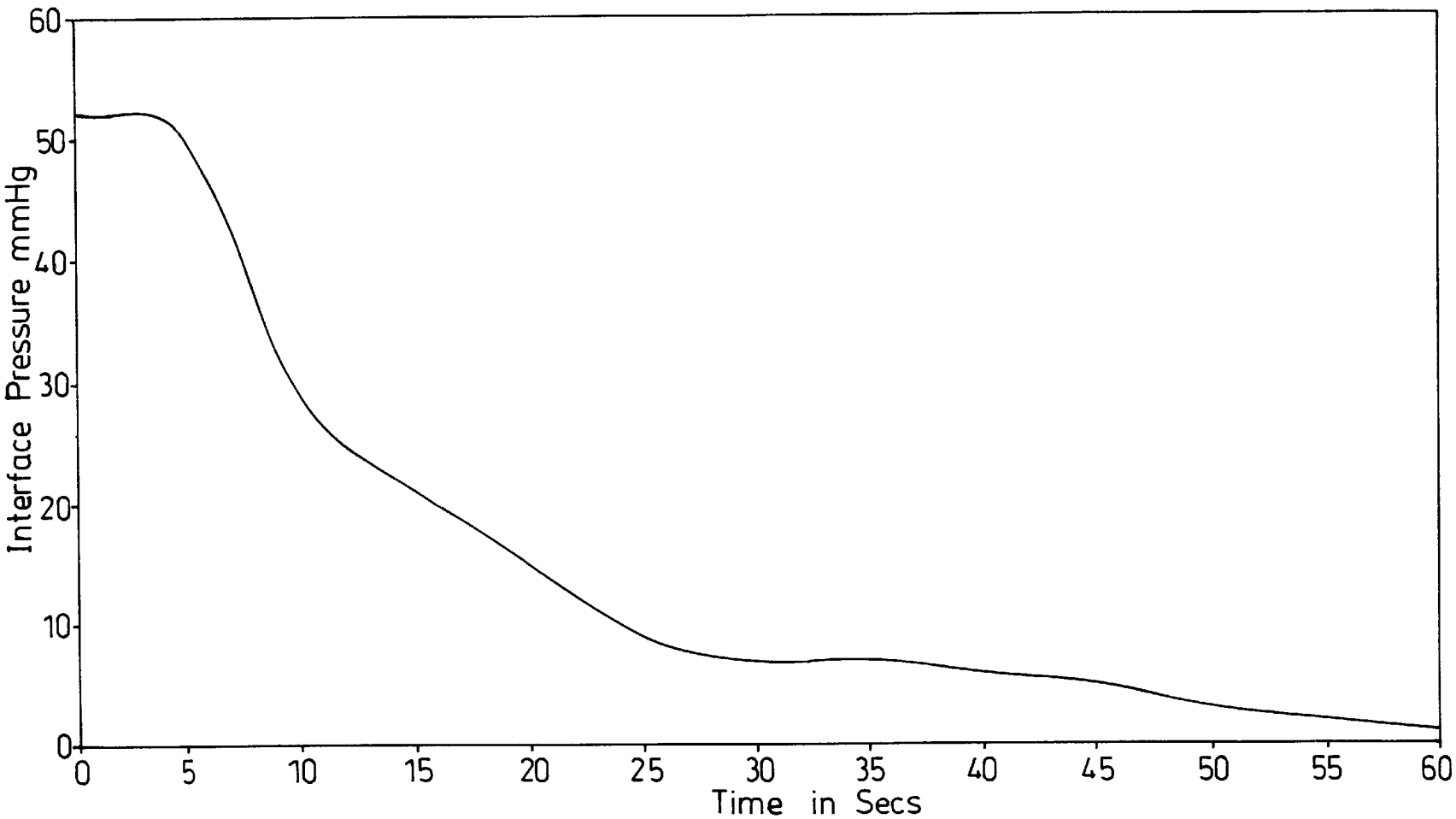

FIGS. 4 and 5 show interface pressures between the mattress and a human patient lying on it, plotted against time, for a mattress using the control system of FIG. 1 and for the standard Pegasus Airwave system. These pressure curves have been measured using a Numotech pressure-mapping device, made by Jasco Products Inc. Of Sun Valley, California, USA. This device is a thin sheet containing a very large number of pressure sensors which are arranged in a rectangular array and are interrogated by data processing techniques to provide a pressure map. FIGS. 4 and 5 show the deflation curve only. FIG. 4 shows that with the Airwave mattress connected to the control device of FIG. 1, interface pressures of 0 mmHg are achieved and that, where the patient has, during the inflated phase of a tube array, an interface pressure of above 20 mmHg, for example 50 mmHg, in the deflation phase the interface pressure falls from 20 mmHg to 5 mmHg in less than 10 seconds. In FIG. 5 by contrast even after 1 minute, zero interface pressure is not obtained, and the pressure fall rate below 20 mmHg is reduced. Below 10 mmHg it is slow.

In a conventional use of an alternating-pressure cells mattress such as the Pegasus Airwave mattress, it is normal to avoid use of a cover sheet over the mattress, because of the fear that "bridging" of the cover sheet between two inflated cells, may occur when the cell between them is deflated, so that the cover sheet might maintain pressure on the patients skin even during the deflation phase of the cell. With the positive driving of the cell pressure to below atmospheric pressure in the device of the present invention, it has been found that this risk in use of a cover sheet is avoided or minimised, so that a cover sheet, of suitable flexibility and preferably extensibility, can be employed. Use of a cover sheet is advantageous, for reasons of hygiene and also for improvement of the appearance of the mattress to the patient.

Preliminary clinical evidence indicates that the rapid removal of pressure provided by the present invention, gives significant benefits in the prevention and treatment of pressure sores. As discussed above, there appears to be a "pressure-induced debt" in the blood flow of patients whose circulation is occluded at low interface pressure levels. To achieve "repayment" of this debt, advantage can be taken of the reactive hyperaemia effect, by rapid removal of interface pressure at the low levels at which occlusion is taking place as a result of the rapid reduction of cell pressure particularly in the range from 10 mmHg to 0 mmHg. By providing positive air extraction, using suction pressure, the rate of removal of interface pressure is maintained even when the body weight of a patient no longer forces the air out of the deflating cells of the mattress. It is believed that improved reactive hyperaemia is obtained. It is possible to achieve a reduction of interface pressure at the rate of 5 mmHg/s from the maximum pressure (inflated pressure of the cells) to the level of 10 mmHg, reducing to 2.5 mmHg/s between 10 and 5 mmHg and then reducing to 0.5 mmHg/s below 5 mmHg, i.e. a time of about 6 s from 20 mmHg to 5 mmHg, and a time of about 12 s between 10 mmHg and 0 mmHg. The overall fall from interface pressure at full inflation of the tubes to 0 takes place in less than 20 s. This provides stimulation of the micro-circulation of the patient, even at very low interface pressures, which it is believed was not possible with a system relying on patient weight to force the air out of the deflating cells. It is possible also that there is a benefit in improved lymphatic flow.

The control system of FIG. 1, in which the deflation means (pumps 8, 9) are controllable independently of the inflation means (compressors 18, 19) allows two further useful modes of operation of the mattress system.

On initial inflation of the mattress, in preparation for its use, all of the mattress cells (tubes) being at first deflated, the control unit (ECU 13) operates the compressors 18, 19 and the rotary valve 14 but suppresses operation of the pumps 8, 9. After all cells have become inflated, by their connection via the rotary valve 14 to the compressors 18, 19, the control means 13 switches itself to the normal cycling mode in which the pumps 8, 9 operate to deflate each group of cells in turn. In this way, the mattress can be made ready for use as quickly as possible, since no air loss occurs during this initiation mode.

During normal cycling operation of the mattress, an operator can select a "static mode" by pressing a control button on the ECU 13. This is done when it is desired that the normal cycling stops but the mattress remains inflated, which is convenient for certain aspects of patient care. When this "static mode" is selected, the ECU 13 continues operation of the compressors 18, 19 and the rotary valve 14 but stops operation of the extraction pumps 8, 9. Consequently any uninflated cells become inflated but no cells are deflated, and the mattress soon becomes fully inflated and remains so. For patient safety, the ECU 13 is programmed to permit this "static mode" to continue for at most a predetermined period, in this embodiment 30 minutes. After 25 minutes an audible warning is given by the ECU 13. The operator is permitted to start the "static mode" again for another period of at most 30 minutes, but the ECU 13 thereafter reverts automatically to the normal cycling mode so that the total duration of "static model" is one hour. The ECU 13 prevents re-selection of "static mode" for one further hour following its cessation. At any time, the operator may exit from "static mode" into the normal cycling mode, by pressing the normal operation command button on the ECU 13.

REFERENCES (1) Clark M., Watts S., Chapman R., Field K., and Carey G.—The Financial Cost of Pressure Sores to the NHS. Report of the Nursing Practise Research Unit 1992, University of Guildford.

(2) Young J—Preventing Pressure Sores: Does the Mattress Work? The Journal of The Tissue Viability, January 1992, Vol. 2 No. 1.

(3) Exton-Smith A. N., Wedgewood J., Overstall P. W., and Wallace G.,—Use of the 'Airwave System' to Prevent Pressure Sores in Hospital. The Lancet, Jun. 5 1982, pp 1288–1290.

(4) St Clair M.—A Survey of the Uses of the Pegasus Airwave System Within United Kingdom Hospitals and Hospices and It's Contribution to Pressure Sore Management. Journal of Tissue Viability, January 1992, Vol. 2 No. 1.

(5) Landis Eugene M.,—Micro-Injection Studies of Capillary Blood Pressure in Human Skin. Heart V15, 1929–1931.

(6) Le K. M. et al—An In-Depth Look at Pressure Sores Using Monolithic Silicon Pressure Sensors. J Plast. Reconst. Surg. 74:745–754, 1984.

(7) Sangeorzan B. J. et al—Circulatory and Mechanical Response of Skin to Loading. Journal of Orthopaedic Research 7:425–431 Raven Press Ltd., New York.

(8) Kosiak M.—Etiology of Decubitus Ulcers. Arch. Phys. Med. & Rehab. 19–29 (Jan) 1961.

(9) Lewis T. and Grant R.—Observations Upon Reactive Hyperaemia in Man. Heart 12: 73–120, 1925.

(10) Blair D. A. et al—The Abolition of Reactive and Post Exercise Hyperaemia in the Forearm by Temporary Restriction of Arterial Inflow. J. Physiol. London 148:648, 1959.

What is claimed is:

1. A method of applying alternating pressure to a supported part of a patient to minimize a risk of pressure sores caused by prolonged pressure applied to the skin of the supported part of the patient, said method comprising the steps of:

supporting a supported part of the patient on a support which includes inflatable elements having height-displaceable upper portions which elements are inflated to respectively exert an interface pressure on the overlying skin portions of the supported part of the patient;

inflating and deflating the elements cyclically in a predetermined sequence such that relative heights of the upper portions of the inflated and deflated elements differ, and the height of the upper portions of the deflated elements in conjunction with the height of the upper portions of the adjacent inflated elements causes a withdrawal of the interface pressure from the overlying skin portions of the deflated elements, said deflating step including the step of rapidly lowering the height of an inflated element to effect a reduction of the interface pressure from 20 mmHg (270 Pa) to 5 mmHg (68 Pa) in not more than 15 s.

2. A method of applying alternating pressure to a supported part of a patient as claimed in claim 1, wherein said rapidly lowering step effects a reduction of interface pressure from 20 mmHg to 5 mmHg in not more than 10 s.

3. A method of applying alternating pressure to a supported part of a patient as claimed in claim 1, wherein said rapidly lowering step effects a reduction of interface pressure from 20 mmHg to 0 mmHg.

4. A method of applying alternating pressure to a supported part of a patient as claimed in claim 1, wherein the height-displaceable elements are upper portions of inflatable elements of flexible material.

5. A method of applying alternating pressure to a supported part of a patient as claimed in claim 1, wherein said supporting step includes the step of providing at least one sheet of flexible material between the patient and the height-displaceable elements.

6. A method of supporting a patient to minimize a risk of pressure sores caused by prolonged pressure applied to a skin of a supported part of the patient, said method comprising the steps of:

positioning the patient on a support, the skin of the supported part of the patient being pressed by underlying upper portions of inflatable elements of the support which upper portions are height-displaceable by inflation of the element;

inflating and deflating the elements of the support adjacent the supported part of the patient cyclically in a predetermined sequence which causes relative heights of the upper portions of the inflated and deflated elements to differ such that the height of the upper portions of the deflated elements in conjunction with the height of the upper portion of adjacent inflated elements causes a withdrawal of an interface pressure from skin portions of the patient overlying the deflated elements, said deflating of the elements step including the step of rapidly lowering the height of an inflated element to effect a reduction of interface pressure on the overlying skin portion thereof from 20 mmHg (270 Pa) to 5 mmHg (68 Pa) in not more than 15 s.

7. A method of supporting a patient to minimize a risk of pressure sores as claimed in claim 6, wherein said rapidly lowering step effects a reduction of interface pressure from 20 mmHg to 5 mmHg in not more than 10 s.

8. A method of supporting a patient to minimize a risk of pressure sores as claimed in claim 6, wherein said rapidly lowering step effects a reduction of interface pressure from 20 mmHg to 0 mmHg.

9. A method of supporting a patient to minimize a risk of pressure sores as claimed in claim 6, wherein the height-displaceable elements are upper portions of inflatable elements of flexible material.

10. A method of supporting a patient to minimize a risk of pressure sores as claimed in claim 6, wherein said positioning step includes the step of providing at least one sheet of flexible material between the patient and the height-displaceable elements.

11. A method of supporting a patient to minimize a risk of pressure sores caused by prolonged pressure applied to a skin of a supported part of the patient, said method comprising the steps of:

positioning the patient on a support, the skin of the supported part of the patient being pressed by underlying upper portions of inflatable elements of the support which upper portions are height-displaceable by inflation of the elements;

generating support with selected groups of the elements for overlying skin portions of the supported part of the patient, said generating step including the step of cyclically inflating the elements of the selected group so that an interface pressure applied by the inflated elements to the overlying skin portions of the patient increases from less than 5 mmHg (68 Pa) to greater than 20 mmHg (270 Pa); and cyclically reducing the support applied by an inflated group of elements for overlying skin portions so that the interface pressure applied thereby to an overlying skin portion of the patient decreases from 20 mmHg (270 Pa) to 5 mmHg (68 Pa) in not more than 15 s.

12. A method of supporting a patient to minimize a risk of pressure sores as claimed in claim 11, wherein said cyclically reducing step reduces interface pressure from 20 mmHg to 5 mmHg in not more than 10 s.

13. A method of supporting a patient to minimize a risk of pressure sores as claimed in claim 11, wherein said cyclically reducing step reduces interface pressure from 20 mmHg to 0 mmHg.

14. A method of supporting a patient to minimize a risk of pressure sores as claimed in claim 11, wherein the height-displaceable elements are upper portions of inflatable elements of flexible material.

15. A method of supporting a patient to minimize a risk of pressure sores as claimed in claim 11, wherein said positioning step includes the step of providing at least one sheet of flexible material between the patient and the height-displaceable elements.

16. An apparatus which applies alternating pressure to a supported part of a patient to minimize a risk of pressure sores caused by prolonged pressure applied to the skin of the supported part of the patient, said apparatus comprising:

a support having a plurality of inflatable elements having height-displaceable upper portions which are cyclically raised and lowered by inflation and deflation of said elements;

an inflator of said elements, said inflator being activated to inflate said elements with pressurized air;

a deflator of said elements, said deflator being activated to deflate said elements of air;

a controller which actuates said inflator and deflator in a predetermined cyclical sequence so that each said element is cycled through inflation and deflation cycles;

wherein said deflator includes a mechanism which rapidly lowers a height of each height-displaceable upper portion during deflation of an associated inflatable element such that a reduction of interface pressure applied by said associated inflatable element to the skin of the patient thereover is effected from 20 mmHg (270 Pa) to 5 mmHg (68 Pa) in not more than 15 s.

17. An apparatus which applies alternating pressure to a supported part of a patient as claimed in claim 16, wherein said mechanism effects a reduction of interface pressure from 20 mmHg to 5 mmHg in not more than 10 s.

18. An apparatus which applies alternating pressure to a supported part of a patient as claimed in claim 16,wherein said mechanism effects a reduction of interface pressure from 20 mmHg to 0 mmHg.

19. An apparatus which applies alternating pressure to a supported part of a patient as claimed in claim 16,wherein said height-displaceable elements are upper portions of inflatable elements made of a flexible material.

20. An apparatus which applies alternating pressure to a supported part of a patient as claimed in claim 16, and further including at least one sheet of flexible material between the patient and the height-displaceable elements.

21. An apparatus which applies alternating pressure to a supported part of a patient to minimize risk of pressure sores caused by prolonged pressure applied to the skin of the supported part of the patient, said apparatus comprising:

a support including a plurality of inflatable cells having height displaceable upper portions which said upper portions are cyclically raised and lowered by inflation and deflation of said cells;

at least one inflator of said cells which inflates said cells with pressurized air;

at least one deflator of said cells which deflates said cells by removal of air; and a controller which controls operation of said at least one inflator and said at least one deflator so that each cell is cycled repeatedly through an inflation and deflation cycle;

wherein said at least one deflator rapidly lowers a height of the upper portion of said cell during deflation thereof so that a reduction of interface pressure applied by the upper portion to the skin of the patient thereover is effected from 20 mmHg (270 Pa) to 5 mmHg (68 Pa) in not more than 15 s.

22. An apparatus which applies alternating pressure to a supported part of a patient as claimed in claim 21, wherein said at least one deflator effects a reduction of interface pressure from 20 mmHg to 5 mmHg in not more than 10 s.

23. An apparatus which applies alternating pressure to a supported part of a patient as claimed in claim 21,wherein said at least one deflator effects a reduction of interface pressure from 20 mmHg to 0 mmHg.

24. An apparatus which applies alternating pressure to a supported part of a patient as claimed in claim 21,wherein said height-displaceable upper portions are made of a flexible material.

25. An apparatus which applies alternating pressure to a supported part of a patient as claimed in claim 21, and further including at least one sheet of flexible material between the patient and the height-displaceable upper portions of said inflatable cells.

26. An apparatus which applies alternating pressure to a supported part of a patient to minimize a risk of pressure sores caused by prolonged pressure applied to the skin of the supported part of the patient, said apparatus comprising:

a support including a plurality of elements having height-displaceable upper portions which said upper portions are cyclically raised and lowered by inflation and deflation of said elements;

a controller comprising a source of pressurized air, which controls inflation and deflation of said elements so that each said element is cycled repeatedly through an inflation and deflation cycle;

said elements and said controller being adapted so that in said inflation and deflation cycle said height-displaceable upper portion of the element is rapidly lowered during deflation of the element such that a reduction of interface pressure applied by the upper portion to the skin of the patient thereover is effected from 20 mmHg (270 Pa) to 5 mmHg (68 Pa) in not more than 15 s.

27. An apparatus which applies alternating pressure to a supported part of a patient as claimed in claim 26, wherein said elements and said controller effect a reduction of interface pressure from 20 mmHg to 5 mmHg in not more than 10 s.

28. An apparatus which applies alternating pressure to a supported part of a patient as claimed in claim 26,wherein said elements and said controller effect a reduction of interface pressure from 20 mmHg to 0 mmHg.

29. An apparatus which applies alternating pressure to a supported part of a patient as claimed in claim 26,wherein said height-displaceable upper portions are made of a flexible material.

30. An apparatus which applies alternating pressure to a supported part of a patient as claimed in claim 26, and further including at least one sheet of flexible material between the patient and the height-displaceable upper portions of said elements.

* * * * *